US007185959B2

(12) United States Patent
Mueller et al.

(10) Patent No.: US 7,185,959 B2
(45) Date of Patent: Mar. 6, 2007

(54) DRAWER SLIDE

(75) Inventors: Wolfgang Mueller, Lustenau (AT); Harald Gehrer, Höchst (AT); Klaus Schneider, Höchst (AT)

(73) Assignee: Grass GmbH, Hochst/Voralberg (AT)

( * ) Notice: Subject to any disclaimer, the term of this patent is extended or adjusted under 35 U.S.C. 154(b) by 479 days.

(21) Appl. No.: 10/465,700

(22) Filed: Jun. 19, 2003

(65) Prior Publication Data

US 2004/0017139 A1 Jan. 29, 2004

(30) Foreign Application Priority Data

Jun. 26, 2002 (DE) ..... 102 28 470

(51) Int. Cl.
*A47C 88/00* (2006.01)

(52) U.S. Cl. ..... 312/331; 312/334.42; 312/334.44

(58) Field of Classification Search ..... 312/331, 312/333, 334.44, 334.42; 384/21
See application file for complete search history.

(56) References Cited

U.S. PATENT DOCUMENTS

| | | | | |
|---|---|---|---|---|
| 1,736,108 A * | 11/1929 | Bullen et al. | ..... | 312/286 |
| 1,902,795 A * | 3/1933 | Wolters | ..... | 312/331 |
| 3,700,301 A * | 10/1972 | Boeck | ..... | 312/333 |
| 4,983,000 A | 1/1991 | Rock | | |
| 5,207,781 A | 5/1993 | Rock | | |
| 5,421,648 A | 6/1995 | Grabher | | |
| 2003/0067257 A1* | 4/2003 | Gasser | ..... | 312/331 |
| 2004/0017138 A1* | 1/2004 | Mueller et al. | ..... | 312/333 |

FOREIGN PATENT DOCUMENTS

| | | |
|---|---|---|
| DE | 1262533 | 3/1968 |
| DE | 40 19 124 C2 | 6/1994 |
| EP | 1036526 A1 | 2/2000 |
| FR | 2514236 A1 * | 4/1983 |
| GB | 2373994 A | 10/2002 |

* cited by examiner

*Primary Examiner*—Joseph Edell
(74) *Attorney, Agent, or Firm*—John M. Harrington Kilpatrick Stockton LLP

(57) ABSTRACT

The invention concerns a drawer slide with compensation of synchronous running errors of slide rails (equalize the errors of the relative positions of the slide rails to each other), having on each of the two side of the drawer a rail system, that has a cabinet rail fastened directly or indirectly by a cabinet angle on a cabinet body and is held directly or indirectly linearly movable by a linear bearing by a center rail on a drawer rail, which is connected directly or indirectly by a décor with the drawer; whereby a compensation mechanism is provided that has a compensation lever, that is connected by a pivot bearing directly or indirectly by a cabinet angle or linear bearing or décor with one of the rails, and during its turning at the end of each drawer closing cycle, reaches a positive/form-fitting position with stops, that directly or indirectly are connected by a cabinet angle or linear bearing or décor with the remaining rails and, thus, ensures each drawer closing is automatic, guided and has equalized any synchronous running error.

11 Claims, 5 Drawing Sheets

VII
VII

XII
XII

DRAWER SLIDE

FIELD OF THE INVENTION

The invention concerns a drawer slide with compensation of the synchronous running errors of the slide rails that equalize the errors of the relative positions of the slide rails to each other, according to the characterizing clause of the independent claims.

BACKGROUND OF THE INVENTION

Drawer slide with synchronization of the slide rail runs are made known, for example, by DE-40 19 124 C2, DE-42 26 812 A1 and DE-92 19 064 U1, that refer back to the same applicant.

DE-42 26 812 A1 and DE-92 19 064 U1, which refers back to it, make known a drawer slide with full extension and a traction mechanism, which consists of a drawer rail, a center rail and a cabinet rail, so that a load transferring carriage is located between the rails. In order to achieve a synchronous shift between the center rail when the drawer rails slide, a traction mechanism (rope, chain, etc.) is provided, which runs over the deflection rollers on the center rail. The upper trunk of the traction mechanism is connected to both ends of the upper carriage, while the lower trunk is connected to the ends of the lower carriage.

DE-40 19 124 C2 describes a full extension that corresponds to the type of differential slide with a drawer that has a cabinet rail with cabinet rail rollers, a center rail and a drawer rail; whereby, the center roller has deflection rollers, across which a traction band is guided, which is fastened to the cabinet rail so that when the drawer rail moves, the center rail goes along synchronously. In order to achieve a slide that is clearance-free and play-free and has a synchronous glide, it is provided that the carriage is located movable on the center rail so that the drawer rail engages clearance-free and play-free with the carriage and the deflection rollers, and that the traction band has a carrier, which moves the carriage in given positions and further forms a catch on the traction band that engages in a recess of the drawer rail and has the means on which the drawer, during its closing, sinks automatically.

Synchronization systems of this type generally have the purpose of adjusting deviations of relative movements of the slide rails, especially the cabinet-, center- and drawer rails of full extension systems, which are systematically present after each opening and closing.

The deviations of relative movements of the slide rails are recognizable by a depth gap (distance of the drawer front's inner surface to the cabinet's front face surface) of the drawer, that increases, for example, from approximately 1–1.5 mm to 3–4 mm if the drawer is pulled up and subsequently pushed in again. The front gap also increases constantly, so that this error, without a suitable compensation device, can only be corrected if the user presses the drawer with increased force against the rear stop. The reasons for the depth gap errors are many-fold and lead back to the slipperiness and elasticity of the rollers, the buckling and/or bending of the rail sheet metal and tilting of the slides and wheels during the drawer's openings and closings.

The disadvantage of compensation mechanisms of the slide rail's synchronous running errors, according to the state of the art specified above, is that for the reasons described above, despite the synchronization, synchronous running errors still occur and the devices made are relatively complicated and, therefore, are cost-intensive and susceptible to needing maintenance and repairs.

SUMMARY OF THE INVENTION

The task of the present invention is to submit a drawer slide that has a compensation mechanism for the synchronous running errors of slide rails and is designed more simply and cost-effectively, requiring fewer maintenance and repairs and operates with better quality.

The technical precepts of the independent claims serve to solve the task.

A fundamental characteristic here is that a compensation mechanism has a compensation lever that is connected swiveling by a pivot bearing directly or indirectly by a linear bearing or décor with one of the rails, and which by means of rotation at the end of each of the drawer's closing cycles, achieves a form-fitting position with stops, that are directly or indirectly connected by the cabinet angle or linear bearing or décor with all the remaining rails and, thus, in each of the drawer's closing positions has a more automatic, more forced guided balance and equalization of the synchronous running error.

The advantage here is that the compensation device, according to the invention, is designed to be more cost efficient, to require less maintenance and repairs, to be more reliable and durable, and to have a better quality than the state of technology, and to keep the depth gap between the drawer's front plate and cabinets constant and precise.

Thus, the compensation mechanism system, according to the invention, doesn't work constantly during the drawer's opening and closing, but instead only in the drawer's final closing range, resulting in a basic simplification and cost reduction of the system.

So, the compensation system is not designed as a continues synchronization, but as a so-called pseudo-synchronization or self-adjusting of the depth gap, which operates only within the final range of the drawer's closing and then in the drawer's closing position, brings the individual components to the slide system together in a certain position so that the depth gap between the drawer panel and the cabinet are brought at each closing of the drawer to a constant value. During the opening and closing, if the compensation does not operate, a positional misalignment of the drawer slide's parts can, thus, be present, which, however, is not noticeable and is, therefore, permissible. At the end of the drawer's closing up to the closed position, then the invention's compensation device works so that the error in the misaligned position of the drawer slide's parts are equalized and balanced and the depth gap, after each closing, has again, constant exit value (for example, 1 mm).

It is expressly noted that the present invention is not limited by the subsequent example description of full-extension drawer slides, but can also be used with partial extension drawer slides (without center rails), so that both partial extension and full extension drawer slides can, additionally, be equipped with a continuous synchronization mechanism, according to the state of technology, as mentioned above. This is, however, not necessary to the solution because the invention, even without an additional continuous synchronization mechanism, according to the state of technology, can be used with partial extension and full extension drawer slides.

However, it is preferred that the application of the invention-related compensation system, in particular with a full extension drawer slide with an additional classical synchronization mechanism, is according to the state of the art. In the following this system is described, but these descriptions should not be considered to be restrictive in understanding the invention.

In a preferred embodiment of the invention, the compensation lever is located swiveling on a linear moved drawer rail, and the stops, which, at the end of each of the drawer's closing cycles, reach the compensation lever in a positive/form-fitting engagement or flat installation, are connected directly or indirectly by other drawer slide components with all the remaining linear-moved and/or cabinet-fixed drawer rails.

In a first variation of this preferred embodiment, the compensation lever is located swiveling on the center rail of a full extension drawer slide, so that the compensation lever has two lever arms. At the end of each closing cycle, the drawer with the compensation lever that turns results in the cooperating form-fitting surfaces and/or contact surfaces that are then located on the décor or the drawer rail and on the lower roller carriage (between the center rail and cabinet rail) and on the cabinet angle (direct adapter to the cabinet) or the cabinet rail itself.

The synchronization between the lower and upper roller carriage usually takes place here by toothed racks and pinions, but even there, there is an additional contact surface at the positive/form-fitting engagement and/or at the compensation lever's location by the turning at the end of the drawer's closing cycle.

The double-armed compensation lever sets itself fully here with its longer upper lever arm within the décor's inner space on the stop attached there with a stop surface. At the same time the lower short lever arm of the compensation lever turns in the same turning direction and lies with its bow- and/or circular shaped side-opened notch on a bump on the lower roller carriage. Likewise, at the same time, a nose on the free end of the shorter lever arm lies on a centering cam on the cabinet angle (adapter).

Naturally, a bump-catch-connection between the upper lever arm and the corresponding stop on the décor can also be provided and/or between the shorter lever arm and the adapter, so that here with regard to the formation of the contact surfaces between the compensation lever and parts that can be synchronized, complete freedom should prevail. Also, naturally, a simple contact surface between the lower roller carriage and lever can be present without a positive/form-fitting bump-recess-connection. It is important only that a synchronous adjustment of the position-eccentric parts is achieved by the end of the drawer's closing cycle by means of the lever.

If the compensation lever had ended its turn in the drawer's closing position, then all linear movable parts (drawer rail, center rail and roller carriage) were aligned to all linear stationary cabinet-fixed parts (cabinet rail, cabinet adapter) in the original state, so that the depth gap always stays constant after each drawer closing.

It is, thereby, preferred that both lever arms of the compensation lever are aligned to each other in such a way that they extend in each case from the fulcrum and encompass an angle of about 180°. It is preferred that both longitudinal axes of both lever arms are on the same level and are co-axial, so that the fulcrum lies between the two lever arms. This results in a simple, economical, but effective compensation lever.

In a first variation of equal standing and in a second variation of a preferred embodiment as previously mentioned, the compensation lever is located swiveling on the décor or the drawer rail on a full extension drawer; whereby, the compensation lever has only one lever arm with end-sided guide grooves for the admission of compensation bumps.

At the end of each closing cycle of the drawer, form-fitting surfaces and/or contact surfaces operating together with the surfaces of the guide grooves of the compensation lever are then located on the center rail and on the lower roller carriage (between the center rail and the cabinet rail).

The synchronization between the lower and upper roller carriage usually takes place by means of toothed racks and pinions, but even there, there is an additional contact surface for the positive/form-fitting engagement and/or contact of the compensation lever when turned at the end of the drawer's closing cycle.

The single-arm compensation lever is linked here swiveling by the pivot bearing within the décor's inner space. During the push-in position of the drawer, an induced and dependent turning of the lever twists this from its rest position and both the bumps on the center rail and the lower roller carriage glide along until further turning of the lever in the bump grooves of the lever, until the bumps come to rest at the base of the bump grooves. This corresponds to the compensated end position of the drawer's closed position.

Naturally, the bump-groove-connection can also kinematically be reversed so that the bumps are on the compensation lever and the corresponding guide grooves are on the center rail and/or on the lower roller carriage. Also, a combination of the layouts of bumps and grooves are included in the invention. It is important only that by turning the lever an adjustment of the off-center/eccentric positioned drawer slide components are achieved by the end of the closing cycle.

When the compensation lever has ended its turn in the drawer's closing position, all linear movable parts (drawer rail, center rail and roller carriage) would be aligned to all the stationary, cabinet-fixed parts (cabinet-rail, cabinet adapter) in the original state, so that the depth gap is always kept constant after each drawer closing.

The compensation lever is either s-shaped or z-shaped, formed transverse to the direction of the drawer's travel, so that, on the one hand, it can be brought into the interior of the décor and, on the other hand, can be guided on the drawer rail to the center rail and lower roller bearing.

It is preferred in all variations that the compensation mechanism is located in the front area of the drawer, so that installation, maintenance and repair can be accomplished more simply and easier.

Of course, the present invention can be modified in the context of disclosure with a wide range so that it is not limited to the examples and variations.

In the following the invention is described more closely on the basis of the enclosed drawings and designs, from which further characteristics and advantages are made known.

DETAILED DESCRIPTION

Figure 1:
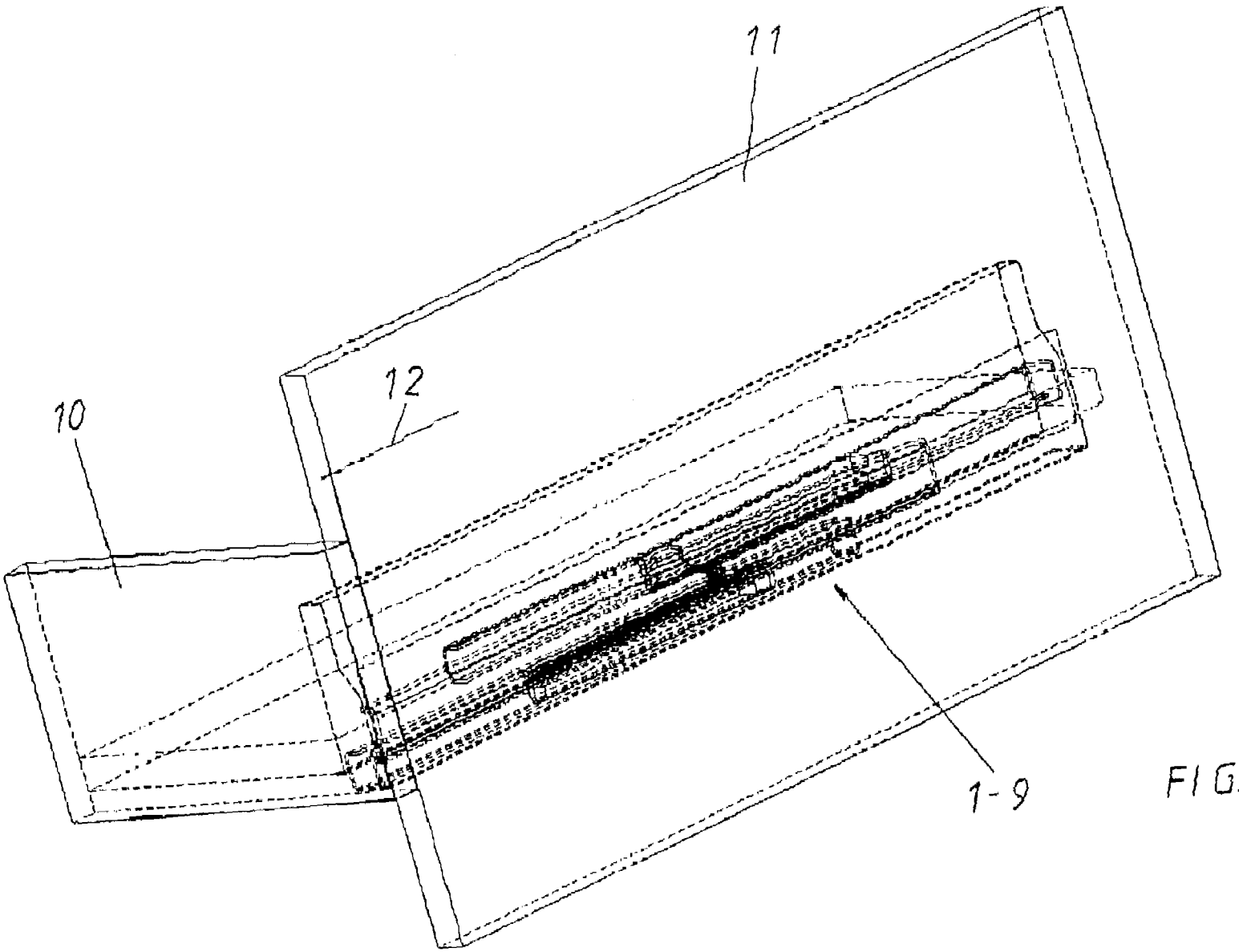
FIG. 1 A perspective partial view of a drawer slide in a completely 'pulled-in' (closed) original state.
Figure 2:
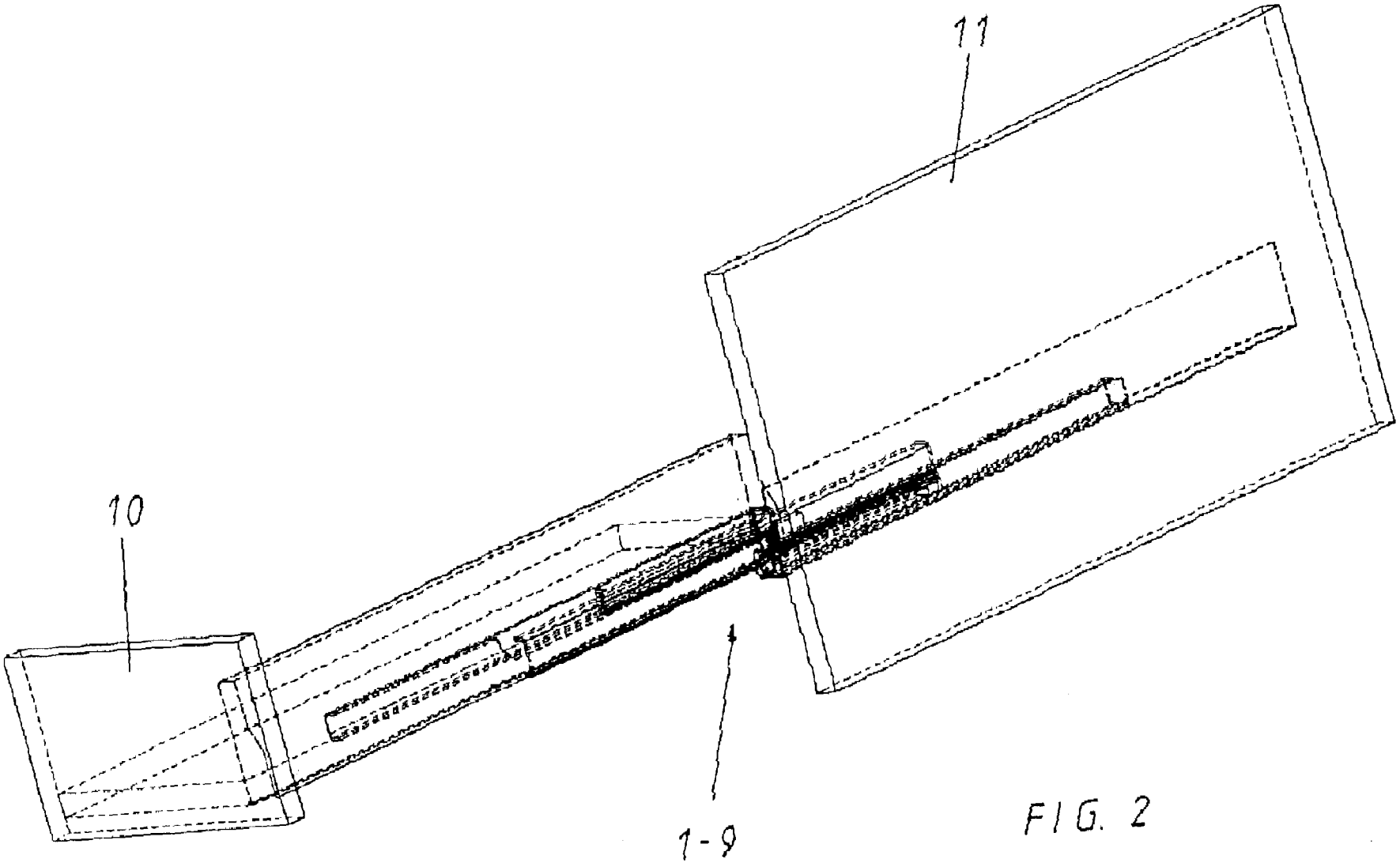
FIG. 2 A perspective partial view of a drawer, according to FIG. 1, in a completely 'pulled-out' (open) state.
Figure 3:
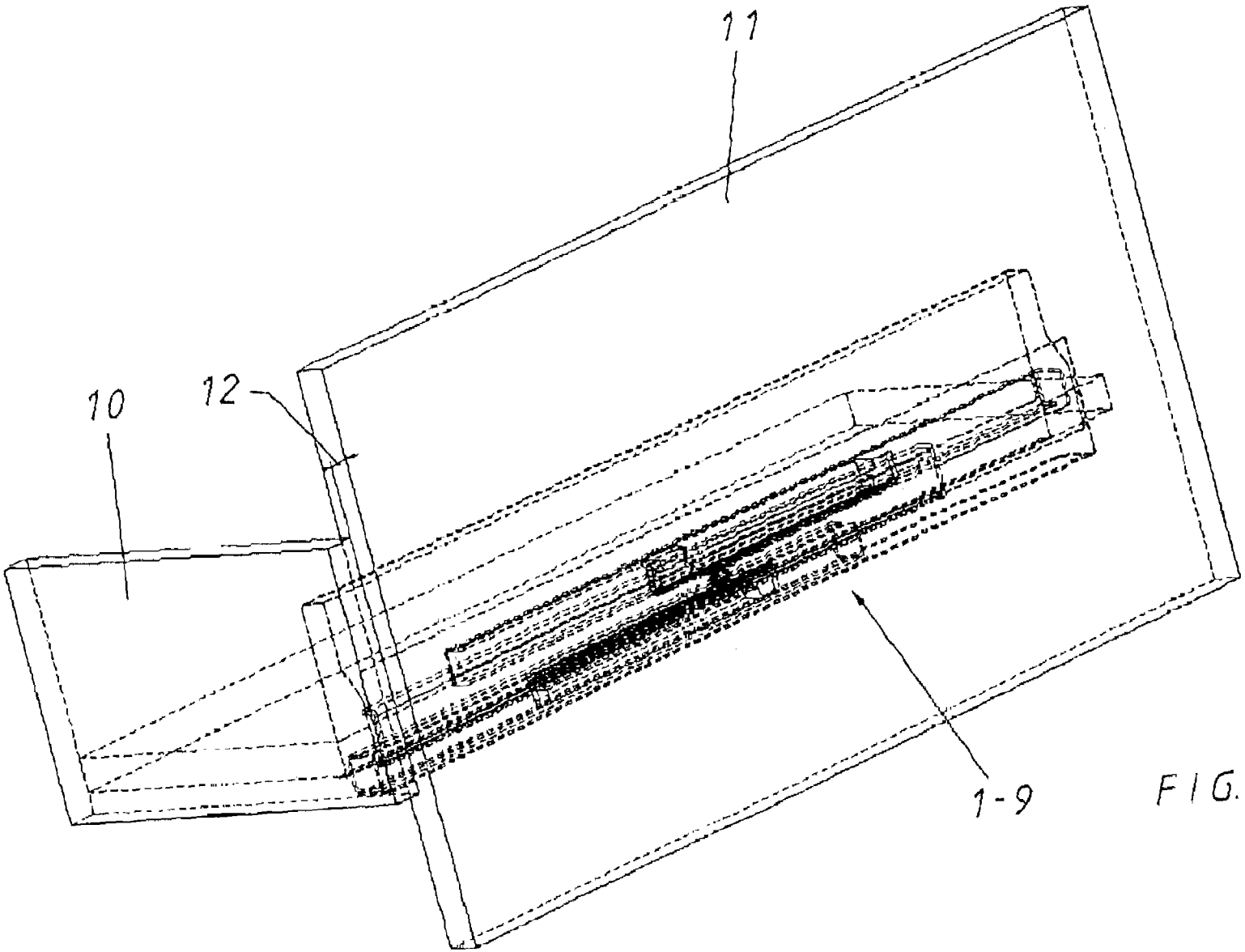
FIG. 3 A perspective partial view of a drawer slide, according to FIG. 1, in a completely 'pulled-in' (closed) position and, subsequently, the drawer in a 'pulled-out' (open) position, according to FIG. 2.

FIGS. 1–3 show general perspective sectional views of a full extension drawer slide, which should clarify the systemic synchronous running error.

FIG. 1 shows the drawer in a completely closed (original) position, for example, after the depth gap has been adjusted between the drawer's front panel and the front face side of the cabinet, which is usually set to approximately 1 mm.

FIG. 2 shows the representation of the full extension drawer when it is completely pulled out of the cabinet; whereby, the whole drawer, together with the décor, projects out of the cabinet opening. A relative movement has taken place between, respectively, the rails (that are working together) by the glide carriage.

FIG. 3 shows the drawer again in its closed state, after it was again pushed into the cabinet from its 'open' position, according to FIG. 2. The front gap increases from its previous 1 mm by the synchronous error and becomes, for example, 3 to 4 mm. This synchronous error is equalized by the invention-related compensation mechanism, so that each time the drawer is closed into the cabinet, the original dimension of the front gap (for example, 1 mm) is adjusted automatically without effort from the user.

Figures 4, 5, 6, 7, 8:
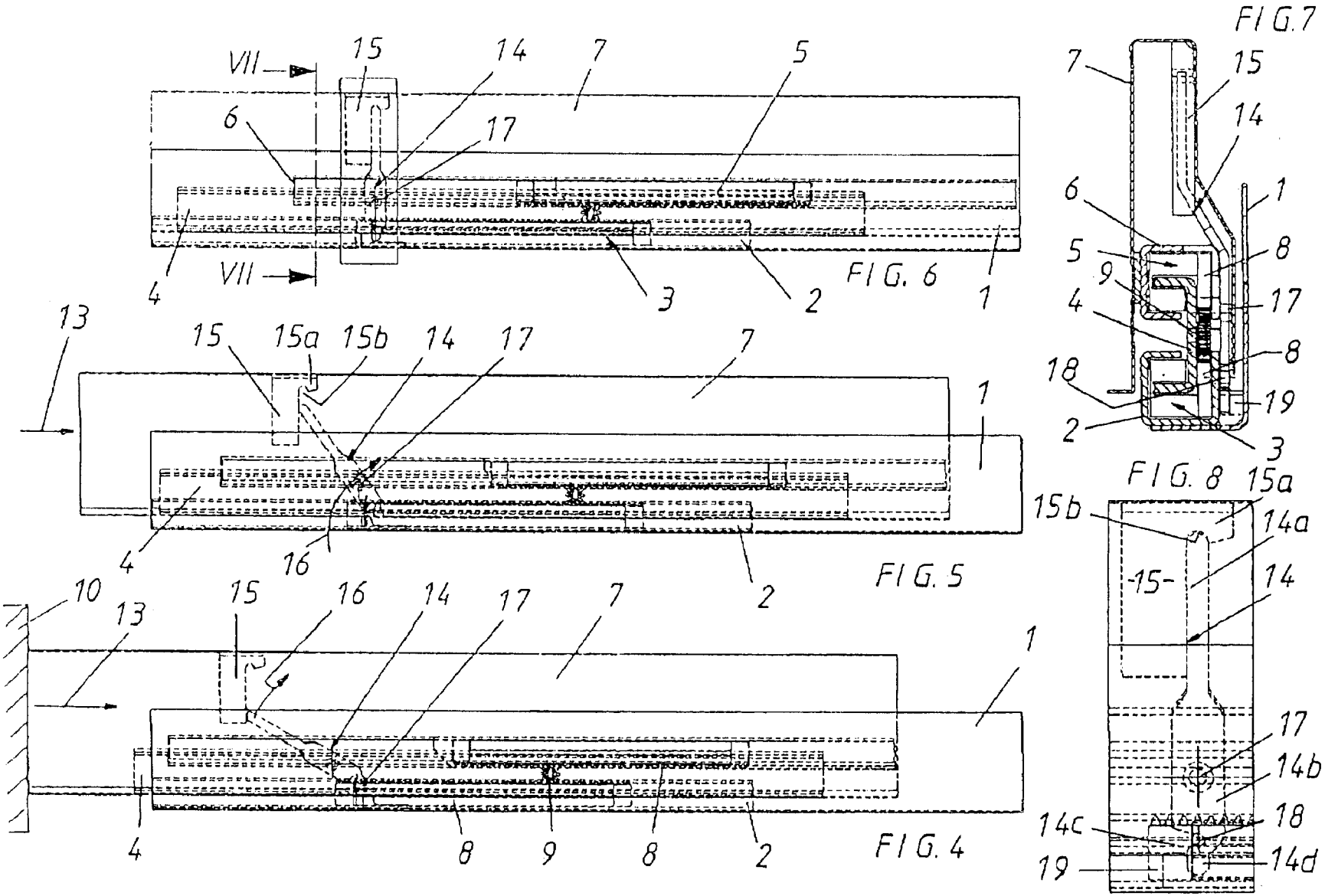
FIG. 4 A side view of the drawer slide with a first invention-related compensation mechanism at the moment it goes into operation.
FIG. 5 A side view of the drawer slide with a first invention-related compensation mechanism, according to FIG. 4, during its operation.
FIG. 6 A side view of the drawer slide with its first invention-related compensation mechanism, according to FIG. 4, when the drawer is completely closed.
FIG. 7 A front view of the section of the drawer slide, according to FIG. 6, along the Line VII—VII.
FIG. 8 An enlarged representation of the first invention-related compensation mechanism, according to FIG. 6.
Figures 9, 10, 11, 12, 13:
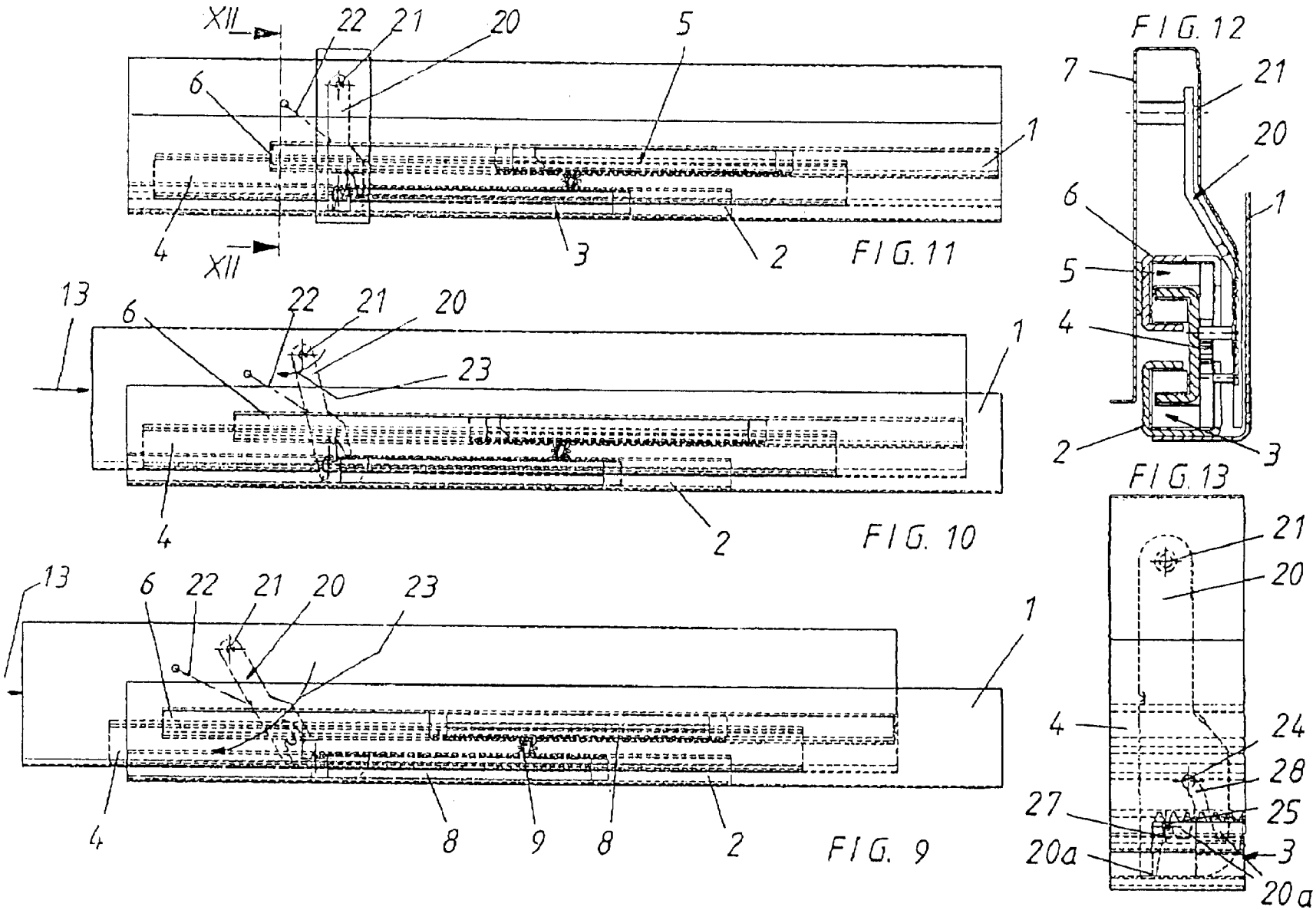
FIG. 9 A side view of the drawer slide with a second invention-related compensation mechanism in the moment it begins to operate.
FIG. 10 A side view of the drawer slide with a second invention-related compensation mechanism, according to FIG. 4, during its operation.
FIG. 11 A side view of the drawer slide with a second invention-related compensation mechanism, according to FIG. 4, when the drawer is completely closed.
FIG. 12 A sectional front view of the drawer slide, according to FIG. 11, along the Line XII—XII.
FIG. 13 An enlarged representation of the second invention-related compensation mechanism, according to FIG. 11.

FIGS. 4–6, as well as 9–11, show the side views of the drawer slide with the invention-related compensation mechanism. FIGS. 8 and 13 show an enlargement of the compensation mechanism and FIGS. 7 and 12 show sectional front views of the drawer slide when the drawer is closed and/or completely 'pushed-in' drawer rails.

The examples show a full extension drawer rail for a drawer slide, which are not to be understood as limiting for the invention. The depth gap error compensation, which was generally described before, can also be used in a partial extension system, and also, additionally, in all variations of drawer slide full extension systems. For reasons of simplification, however, only one type of full extension system is described in the following.

In the examples only one drawer slide for one drawer side is shown; whereby, naturally, a total of two such drawer slides per drawer (left and right side) are necessary.

The drawer slide, according to the figures, has a cabinet-angle (1) that is located stationary inside an opening of a cabinet (not shown) and faces horizontally a drawer slide of the same type. A cabinet rail (2) is fastened to the cabinet angle (1). A center rail (4) is held linearly movable on the cabinet rail (2) by a first glide carriage (3); the center rail again carries, linear movable, a drawer rail (6) by a second glide carriage (5). The décor (7) is fixed to the drawer rail (6), on which the drawer (not shown) is anchored.

A synchronization in the form of a rack (8) and pinion (9) is provided between the cabinet rail's (2) glide carriage (3), the center rail (4) and the drawer rail's (6) glide carriage (5). The toothed rack (8) is here always connected with the cabinet rail's (2) glide carriage (3) and the drawer rail's (6) glide carriage (5) and are engaged with the pinion (9) on the center rail (4). In this manner a balanced movement between the rails (2,4 and 6) is ensured.

FIGS. 4–8 show a drawer slide (1–9) with a first invention-related compensation mechanism (14–19).

When the drawer is inserted in the closing direction (13), the lever (14) goes over a stop (15) fastened on a décor (7). In this way the lever (14), which is held swiveling by a pivot bearing (17) on the center rail (4), while turning in turning direction (16) shifts and swings during the insertion into a bump (18) that is located on the lower roller carriage (3). In addition the lower part (14*b*) of the lever (14) is brought into a centering, that is located on the adapter (1) (cabinet rail). Thus, the drawer is guided on the stop and/or the lever (14) is guided on the stop (15), and the décor (7) (drawer rail), upper roller carriage (5), center rail (4), lower roller carriage (3) and adapter (1) (with cabinet rail) are set in a certain position to one another.

So, the lever (14) is held swiveling by the pivot bearing (17) on the center rail (4) and has an upper part (14*a*) and a lower part (14*b*). When the drawer is pushed in, the upper part (14*a*) of the lever (14) glides on the stop (15) on the décor (7) and is turned out of its rest position, according to FIG. 4, upward in the turning direction (16), according to FIG. 5. The rest position of the lever (14), according to FIG. 4, lies also, for example, around 45° transferred out of the horizontal, which is managed by another stop or a spring so that the lever (14) can also reach the stop (15) in the upper part of the décor (7). The turning of the lever around the pivot bearing (17) is shown in the position according to FIG. 5 and again in the position according to FIG. 6, in which the lever (14) then stays in the vertical and then lies fully on a somewhat vertical contact surface of the stop (15). So that the lever (14) does not turn out of this vertical end position, a stop nose (15*a*) with a rear section (15*b*) on the stop (15) is provided so that the free end of the upper lever arm (14*a*) engages positive/form-fitting in the back section (15*b*) and blocks further turning.

At the same time, the upper part (14*a*) also swivels with the lower part (14*b*) of the lever (14) around the pivot bearing (17) in the turning direction (16) out of the rest position, according to FIG. 4, over the position, according to FIG. 5, into the end position, according to FIG. 6. In this end position the edge-sided open recess (14*c*) of the lower lever part (14*b*) then engages partially the bumps (18) on the lower roller carriage (3) and, simultaneously, the nose (14*d*) of the lower lever part (14*b*) lies on the centering (19) that is found stationary on the cabinet angle (1).

When the drawer is pulled out, the lever (14) turns against the turning direction (16), as previously described analogously in reverse, out of the end position (according to FIG. 6) over the position (according to FIG. 5) into the lever's (14) rest position (according to FIG. 4). The lever (14) is turned in and against the turning direction (16) exclusively by the drawer's closing and opening, which causes a positive/form-fitting run of certain lever parts on contact surfaces that are working together with them.

Thus, in the end position of the levers (14), according to FIG. 6, in which the drawer is pulled completely into the cabinet (11) (with defined depth gap), all linear moved parts of the drawer slide are brought together into a pre-defined relative position, so that the synchronous gliding error of the depth gap is automatically equalized with each drawer closing.

FIGS. 9–13 show a drawer slide with a second invention-related compensation mechanism (20–25). The same construction components are provided with the same reference symbols/drawings as in FIGS. 4–8.

When the drawer is pushed in, the lever (20) that is held swiveling by a pivot bearing (21) on the décor (7), is pressed out of its locked position, according to FIG. 9, and the draw-pull tension spring (22) can transfer its force to the lever (20). Thus, the lever (20) rotates in turn direction (23) and swings, during the insertion, into two bumps (24,25) that are located on the lower roller carriage (3) (bump 25) and on the center rail (4) (bump 24). So, afterwards, the drawer is guided on the stops (bumps 24,25), and the décor (7) (drawer rail), upper roller carriage (5), center rail (4), lower roller carriage (3) and adapter (1) (with cabinet rail) are set to one another in a certain position.

The lever (20) is held swiveling by the pivot bearing (21) on the décor (7) and has on the free end (opposite the pivot bearing) a forking with three points (20*a*), between which are two receptacle grooves (20*b* and 20*c*) of the two bumps (24,25). When the drawer is inserted/pushed in, the lever (20) turns out of its rest position, according to FIG. 9, downward in turning direction (23), according to FIG. 10. The lever's (20) rest position, as shown in FIG. 9, is also, for example, approximately 45°, and moves out of the vertical, which is guided by one or both bumps (24,25) lying on the free end of points (20*a*), or by an additional stop or an additional spring. By turning the lever (20) out of the rest position (according to FIG. 9) in the position shown in FIG. 10, the bumps (24,25) go into the receptacle grooves (20*b*, 20*c*) in the direction of the base receptacle grooves (20*b*, 20*c*) and/or the points (20*a*).

The turning of the lever (20) around the pivot bearing (21) follows then out of the position as shown in FIG. 10 further into the position as shown in FIG. 11, in that the lever (20) then stays somewhat vertically and then the bumps (24,25) lie fully on the base of the guide (holding) grooves (20*b*, 20*c*) and/or points (20*a*). The walls of the guide grooves (20*b*, 20*c*) serve to guide the bumps (24,25) in and out, as restricted guidance.

When the drawer is pulled out, then the lever's (20) end position turns against the turning direction (23) as previously described in reverse, out of the end position as shown in FIG. 11 over the position shown in FIG. 10 in the lever's (20) rest position as shown in FIG. 9. The turning in and against the turning direction (23) of the lever (20) results from the drawer's movement and the spring's activation.

Therefore, all linear moved parts of the drawer slide are brought together in a pre-defined relative position in the lever's (20) end position (shown in FIG. 11) when the drawer is completely pulled into the cabinet (11) (with a defined depth gap), so that the depth gap's synchronous gliding error is automatically equalized with every closing of the drawer.

| Drawing Legend |
|---|
| 1. Cabinet angle |
| 2. Cabinet rail |
| 3. Carriage cabinet rail - center rail |
| 4. Center rail |
| 5. Carriage cabinet rail - drawer rail |
| 6. Drawer rail |
| 7. Décor |
| 8. Toothed rack |
| 9. Pinion |
| 10. Drawer front panel |
| 11. Cabinet body |
| 12. Front gap |
| 13. Closing direction |
| 14. Compensation lever, 14a Upper lever arm, 14b Lower lever arm 14c Notch, 14d Nose |
| 15. Stop, 15a Stop nose, 15b Rear section |
| 16. Turning direction |
| 17. Pivot bearing lever |
| 18. Bump |
| 19. Centering on 1 |
| 20. Compensation lever, 20a Points, 20b Guide groove for bump 25, 20c Guide groove for bump 24 |
| 21. Pivot bearing |
| 22. Draw-pull tension spring |
| 23. Turning direction |
| 24. Bump on center rail 4 |
| 25. Bump on roller carriage 3 |

What is claimed is:

1. Drawer slide with compensation of synchronous running errors of slide rails mountable on each side of a drawer, comprising:

a cabinet rail fastened via a cabinet angle to the cabinet;

a center rail linearly moveably supported on the cabinet rail;

a drawer rail linearly moveably supported on the center rail between open and closed positions of the drawer relative to the cabinet rail;

at least one linear bearing component disposed between two of said rails for linear movement of one of said rails relative to another of said rails;

a compensation mechanism that has a compensation lever connected swiveling by a pivot bearing on one of the cabinet rail, the center rail, the drawer rail, and the linear bearing component and which compensation lever is pivoted in the closed position of the drawer to engagement with the other of the cabinet rail, the center rail, the drawer, rail, and the linear bearing component, forming a connection between the cabinet rail, the center rail, the drawer rail, and the linear bearing component and urging the respective rails and the linear bearing component into a predefined alignment with one another.

2. Drawer slide, according to claim 1, wherein the compensation lever is connected swiveling by the pivot bearing on the center rail.

3. Drawer slide, according to claim 1, wherein the linear bearing component further comprises an upper linear bearing component disposed between the center rail and the drawer rail and a lower linear bearing component disposed between the center rail and the cabinet rail.

4. Drawer slide, according to claim 1, wherein a continuous synchronization mechanism is disposed between the center rail and each of the drawer rail and the cabinet rail.

5. Drawer slide, according to claim 4, wherein the synchronization mechanism further comprises a rack and pinion mechanism.

6. Drawer slide, according to claim 1, wherein the lower bearing component further comprises a lower roller carriage disposed between the center rail and the cabinet rail, and wherein the compensation lever is located swiveling around the pivot bearing on the center rail and further comprises a first lever arm which is pivoted in the closed position of the drawer to engagement with a contact surface on a décor of the drawer rail and a second lever arm that is pivoted in the closed position of the drawer into engagement with a contact surface on the lower roller carriage and a contact surface on the cabinet angle.

7. Drawer slide, according to claim 6, wherein the first lever arm comprises an upper lever arm of the compensation lever and the second lever arm comprises a lower lever arm of the compensation lever, wherein the contact surface on the décor comprises a stop disposed within an interior of the décor, the contact surface on the lower roller carriage comprises a bump formed on the lower roller carriage, and the contact surface on the cabinet angle comprises a centering cam on the cabinet angle, and wherein the upper lever arm is pivoted in the closed position of the drawer to engagement with the stop disposed in the interior of the décor, and the lower lever arm is simultaneously pivoted into engagement between a notch formed in the lower lever arm and the bump on the lower roller carriage, and likewise, at the same time, the lower lever arm is also pivoted into engagement between a nose on the free end of the lower lever arm and the centering cam on the cabinet angle.

8. Drawer slide, according to claim 6, wherein both the upper and lower lever arms of the compensation lever are substantially aligned to each other so that the upper and lower lever arms extend from the pivot bearing at an angle of substantially 180° to one another.

9. Drawer slide, according to claim 1, wherein the compensation lever is disposed substantially transverse to a direction, in which the drawer rail is moveable relative to the cabinet rail and has a shape that substantially conforms to a cabinet-side interior of a décor of the drawer rail.

10. Drawer slide, according to claim 1, wherein the compensation mechanism is located in a front area of the drawer.

11. A drawer slide with a compensation mechanism for synchronizing running errors of slide rails of the drawer slide to equalize positions of the slide rails relative to each other, comprising:

at least one cabinet rail fastenable on a cabinet, a center rail moveably supported via a lower linear beam component on the cabinet rail;

a drawer rail connected to a drawer and movably supported via an upper linear bearing component on the center rail and linearly moveable between open and closed positions of the drawer relative to the cabinet rail; and a compensation lever connected via a pivot bearing to one of the cabinet rail, the center rail, the drawer rail, the upper linear bearing component, and the lower linear bearing component, which compensation lever is pivoted in the closed position of the drawer to engagement with the other of the cabinet rail, the center rail, the drawer rail, the upper linear bearing component and the lower linear bearing component, forming a connection between the cabinet rail, the center rail, and the drawer rail, and the upper and lower linear bearing components and urging the respective rails and linear bearing components into a predefined alignment with one another.

* * * * *